United States Patent [19]

Solomon et al.

[11] 4,067,277

[45] Jan. 10, 1978

[54] AUTOMATIC BUCKRAM ATTACHMENT MACHINE FOR DRAPERIES AND PROCESS

[75] Inventors: Anthony T. Solomon, Reidsville; William B. Crawford, Greensboro, both of N.C.

[73] Assignee: Burlington Industries, Inc., Greensboro, N.C.

[21] Appl. No.: 666,400

[22] Filed: Mar. 12, 1976

[51] Int. Cl.[2] ..... D05B 1/00

[52] U.S. Cl. ..... 112/262; 112/121.14; 112/121.29

[58] Field of Search ..... 112/121.14, 121.15, 112/121.29, 7, 8, 2, DIG. 1, DIG. 2, 262, 265; 269/10, 21

[56] References Cited

U.S. PATENT DOCUMENTS

| | | | |
|---|---|---|---|
| 2,827,867 | 3/1958 | Happe | 112/DIG. 1 |
| 3,400,674 | 9/1968 | McClintock | 112/2 |
| 3,771,475 | 11/1973 | Guichard | 112/121.15 |
| 3,874,311 | 4/1975 | Kenney | 112/121.14 |
| 3,943,864 | 3/1976 | Feighery et al. | 112/8 X |

*Primary Examiner*—Werner H. Schroeder
*Assistant Examiner*—Peter Nerbun
*Attorney, Agent, or Firm*—Cushman, Darby & Cushman

[57] ABSTRACT

The present invention relates to a novel, compact device for attaching correctly sized strips of buckram material along the top edge of an unstretched drapery panel and overcomes prior art alignment difficulties associated between the drapery panel and strips of buckram, while at the same time assuring the production of a square straight edge along the top edge of the drapery panel. The process includes the trimming away of pre-measured portion of the top edge of each panel thereby removing any unevenness that may have occurred during the production of the drapery panel. At the same time, the device maintains a straight flat alignment between the panel and the buckram strip and includes a novel doffing device for removing the drapery panel from the apparatus subsequent to the sewing process.

16 Claims, 14 Drawing Figures

LS-5
LS-6
LS-7
LS-8
LS-11
100
102
104
106
108
110
116
118
120
124
130
134
136
138
140
142
143
144
145
146
199
198
200
206
208
230
232
234
236
238
240
242
244
246
248
254
256
262
264
266
268
270
272
273
274
276
280
284
288
290
296
298
300
302
308
316
326
330
332
338
340
350
352
354
356
358
360
362
364
366
368
370
372
374

100

126
124
112
190
186
156
206
198
154
342
294
256
254
LS-11
199
252
108
230
250
LS-10
P
260
238
262
258
262
116
264
264
266
102
268
330
332
312
344
280
288
286
296
290
292
282
284
114
122
20
P'

AUTOMATIC BUCKRAM ATTACHMENT MACHINE FOR DRAPERIES AND PROCESS

BACKGROUND OF THE INVENTION

Several devices are known in the prior art which are used for sewing pieces of buckram material to the tops of drapery panels. While the prior art has recognized that space utilization is a problem, most previous attempts reached the conclusion the problem is best solved if the sewing machine was moved relative to the work table or if the surface supporting the drapery material were moved relative to the sewing machine.

The prior art devices, however, have not truly overcome space problems since the support tables used with prior art devices of which applicants are aware, are comprised of a large table capable of suporting the entire length and width of drapery panels. It can be appreciated that because of the length and width of certain drapery panels, work tables for supporting such panels must be relatively large in size.

Another problem that has not been recognized in the prior art concerns the proper alignment of the top of the drapery panel with the strip of buckram that is to be joined therewith so that the resulting seam runs along a straight, square edge. This becomes important during the subsequent pleating of the top edge since the top of each finished panel is determined by the subsequent folding of the top edge of the drapery panel to which the buckram has been applied. If the buckram has not been applied correctly, the top edge of the finished panel will not be straight and undesirable folds may well be created in any attempt to straighten out the top edge.

Another problem experienced with prior art apparatus has been the secureness of the clamped relationship between the buckram being applied and the top edge of the panel. Two prior art devices known to the applicant are set forth in Kenney, U.S. Pat. No. 3,874,311 and McClintock, U.S. Pat. No. 3,400,674.

In both the above patents the supply of buckram is supported by the sewing machine. As the sewing machine and drapery panel are moved, one relative to the other, the supply of buckram is placed in contact with the drapery panel just prior to the part where the buckram is sewn in place by the sewing machine. The only clamping that occurs between the strip of buckram and the top edge of the drapery panel is created by the presser foot of the sewing machine. In the Kenney apparatus, the sewing machine moves relative to the work while in the McClintock apparatus the work table moves relative to a fixed sewing machine. In either case, however, because the buckram is being applied to a drapery panel which is moved relative to the sewing machine a wave is, in effect, formed in the panel by the sewing machine presser foot. This creates folds or creases along the top edge of the panel ahead of the presser foot along the unclamped top edge of the panel. Further, the friction caused by the presser foot coming into contact with the drapery panel stretches the drapery material. Thus, when the top of the panel is folded, the top edge will be wider than the body portion of the panel due to the stretching. This, of course, makes the formation of square corners very difficult. In most instances, these folds or creases are immediately sewn in place by means of the sewing machine. Such folds and creases are, of course, undesirable since these appear in amplified form when pleats are subsequently formed along the top edge of the drapery panel.

Another problem not recognized in the prior art concerns the removal of drapery panels from the support or work table subsequent to the sewing process. Drapery panels are, of necessity, usually quite large and removal has, by and large, been a task for the operator. This adds another operator function to the process and increases the time involved. The present invention provides a doffing system which is automatically activated at the proper time so that during the doffing process the operator can be preparing the next panel. Thus, the number of operator tasks have been reduced and the time for the process has also been lessened.

SUMMARY OF THE INVENTION

The present invention relates to a buckram attaching apparatus designed specifically to attach a correctly sized strip of buckram material of the proper length to fit the top edge of an unstretched drapery panel prior to those panels being pleated and finished into completed draperies. The apparatus supported by a main frame, is positioned relatively high so as to allow a drapery carrier truck having a plurality of drapery panels loaded thereon to be positioned under the frame. Without removing an entire panel from the carrier, an operator would lift the top portion of one panel and place that top portion on a work support surface that is pivotally attached to the frame and movable between loading and sewing positions. Likewise, a clamping device, which extends across the length of the machine, is also pivotally attached to the frame member and is operated in a time relationship to the work support surface.

As indicated above, a significant problem in attaching buckram strips to drapery panels concerns the proper aligning of the drapery panel with the strip of buckram. During the loading cycle, both the work support surface hereinafter referred to as a loading bar, and the clamping device are in a raised load position with the leading edge of the loading bar being adjacent the clamping edge of the clamping device. A recessed area is provided along the length of the clamping edge and on the upper side thereof and is adapted to receive the leading edge of the drapery panel. When the operator places the top portion of the panel onto the loading bar, the leading edge of the panel is placed within this recessed area thereby assuring proper alignment of the panel with respect to the leading edge of the loading bar, the clamping edge, the top edge of the strip of buckram and the trimming device on the sewing machine. This recess also serves another purpose. It is essential that the drapery panel, when clamped relative to the strip of buckram, extend a predetermined distance beyond the strip of buckram toward the sewing machine so that during the sewing process, a portion of the drapery panel can be trimmed and gaps in the finished seam are prevented. By placing the panel's top edge in this recess, the proper amount of overhang is assured as is a straight square finished edge which is parallel to the edge of the buckram material.

The device also includes a novel doffing arrangement which removes the panel from the apparatus following the sewing operation and deposits the completed drapery panel back onto the drapery carrier. In addition, a control circuit is provided which automatically controls the sequencing of the various operations in the process.

Thus, the present invention provides apparatus which clamps the top edge in a relaxed condition along its entire width so that during the sewing operation the drapery material is not stretched nor are folds or puckered areas created in either the panel or the buckram by the traversing sewing machine. The apparatus also overcomes significant space problems associated with prior art devices. The entire apparatus is not substantially wider than the drapery carrier and by being designed such that the drapery carrier itself can be placed beneath the apparatus, drapery panels are not only very convenient to the operator, but allows the doffing device to place each finished panel on the same drapery carrier and removes the carriers from the aisles in the plant. Likewise, since the loading bar itself supports only the top portion of the panel, there is no requirement that large support tables be used which take up inordinately great amounts of floor space in a drapery plant.

A supply of buckram material is held on the frame adjacent the side of the apparatus where the sewing machine is positioned at the end of the sew cycle. The sewing machine is positioned over the strip of buckram at the end of the sew cycle in such a way that a new supply of buckram is pulled off the supply as the sewing machine is moved back to its original start position and automatically positioned in the device.

The present invention possesses many other advantages and has purposes in addition to those discussed above which will now be made clear from the following specification. While a preferred embodiment of the present invention is shown and discussed in the drawings accompanying and forming a part of this specification, these drawings will now be described in detail and should not be taken in a limiting sense. The drawings are supplied for the purpose of illustrating the preferred embodiment, but the scope of the invention is best defined by the appended claims.

Figures 1, 2:
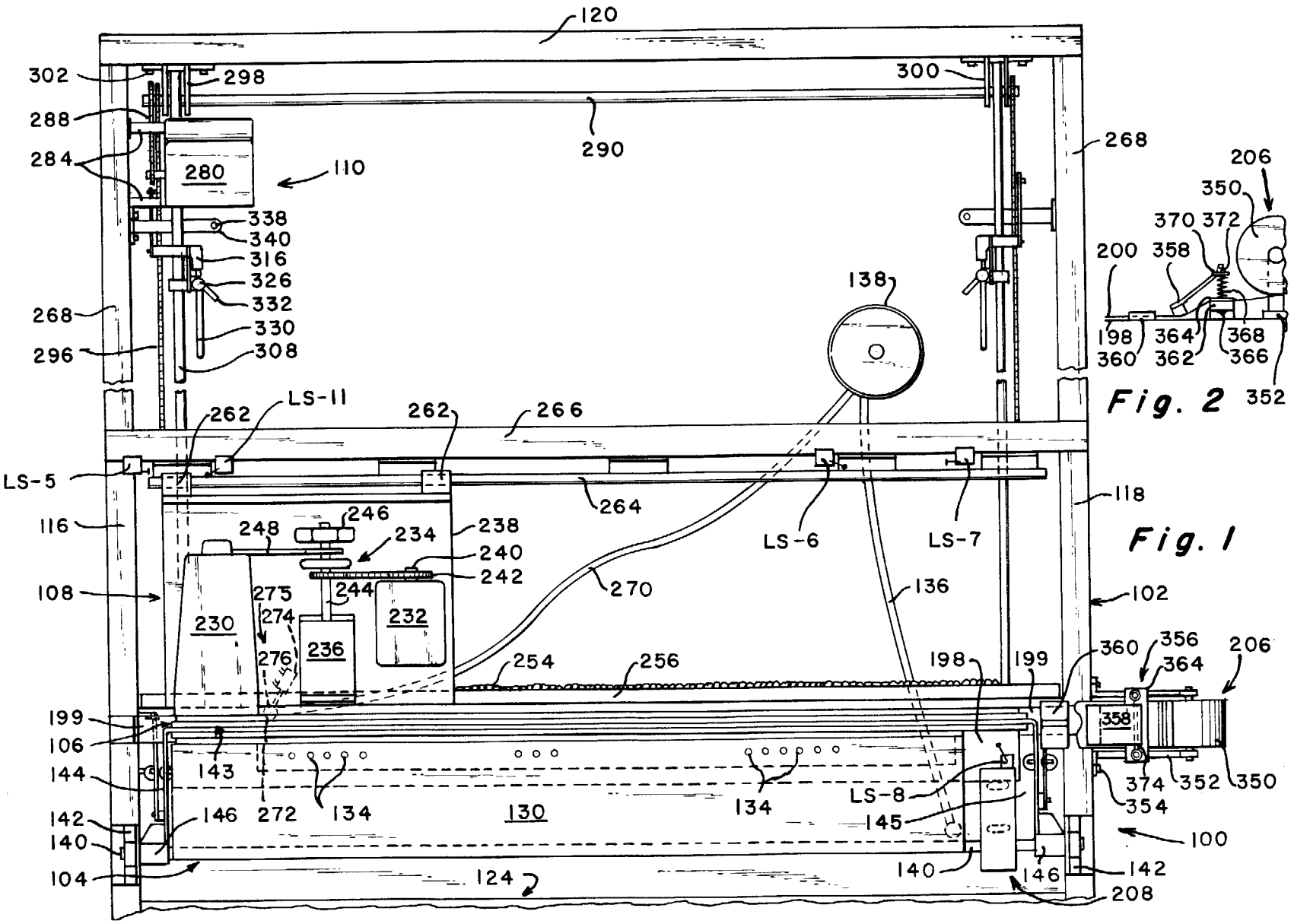
FIG. 1 shows a top plan view of the preferred exemplary embodiment of the drapery sewing apparatus made in accordance with the present invention.
FIG. 2 shows an enlarged fragmentary sectional view taken along lines 2—2 of FIG. 1.

Referring first to FIG. 1, the buckram sewing device, indicated at 100, is comprised of a main frame 102, a loading bar assembly 104, a clamping bar assembly 106, a traversing sewing machine assembly 108 and a doffing assembly 110.

Figure 3:
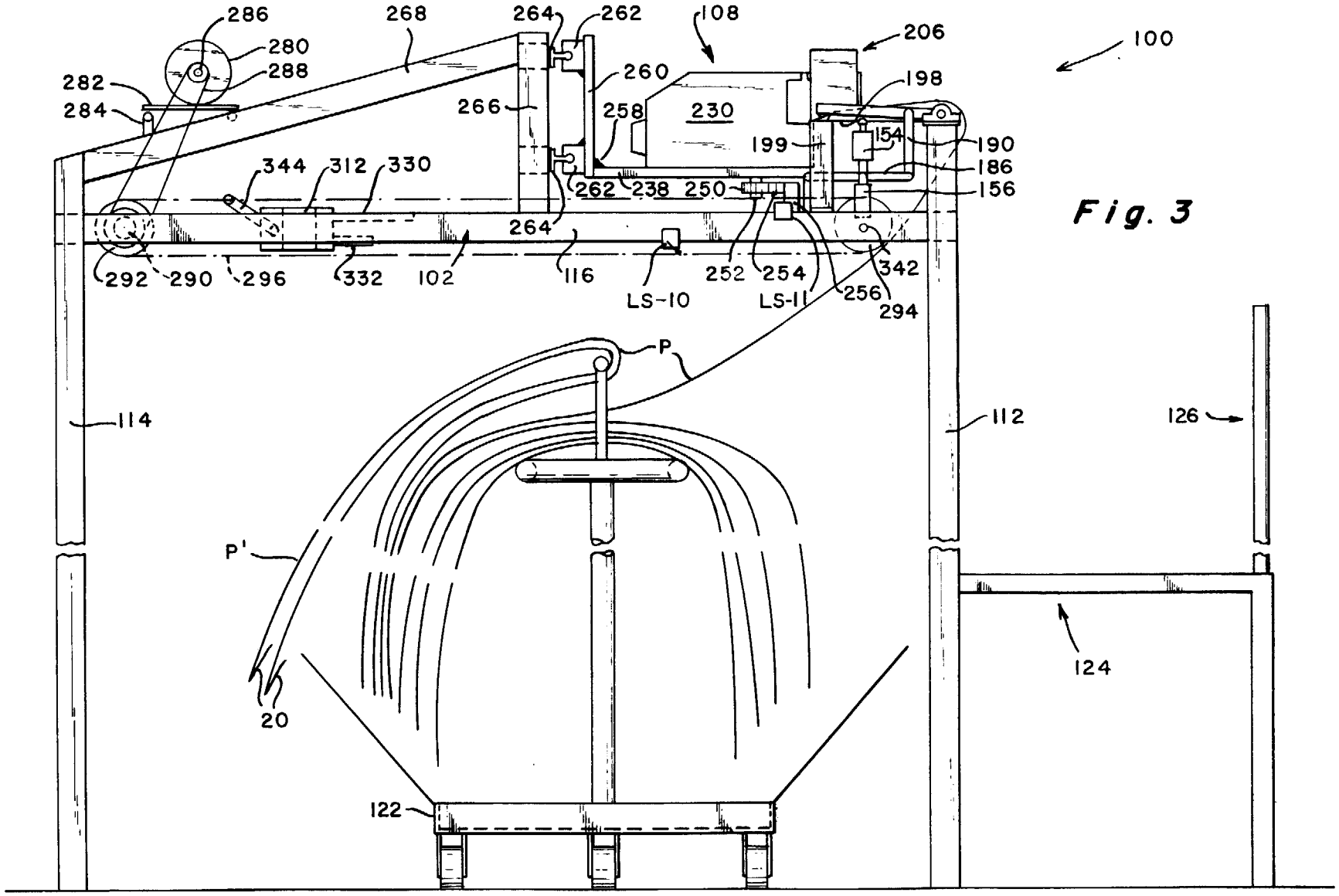
FIG. 3 shows a side elevational view of the apparatus built according to the present invention.

As is best shown in FIGS. 1 and 3, the main frame 102 is provided with front and rear legs 112 and 114 respectively, right and left side horizontal support members 116 and 118 respectively, and a plurality of support members 120 which extend along the length of the device between the legs and side supports.

As best can be seen from FIG. 3, legs 112 and 114 of the main frame 102 are of a sufficient length to allow a drapery panel carrier truck 122 to be moved beneath the device specifically the horizontal and lengthwise support members 116, 118 and 120. Also, in order to have the operator at a convenient height to operate the device, an operator platform 124 is provided at the front of the frame 102 along with a suitable handrail generally indicated at 126.

Figure 4:
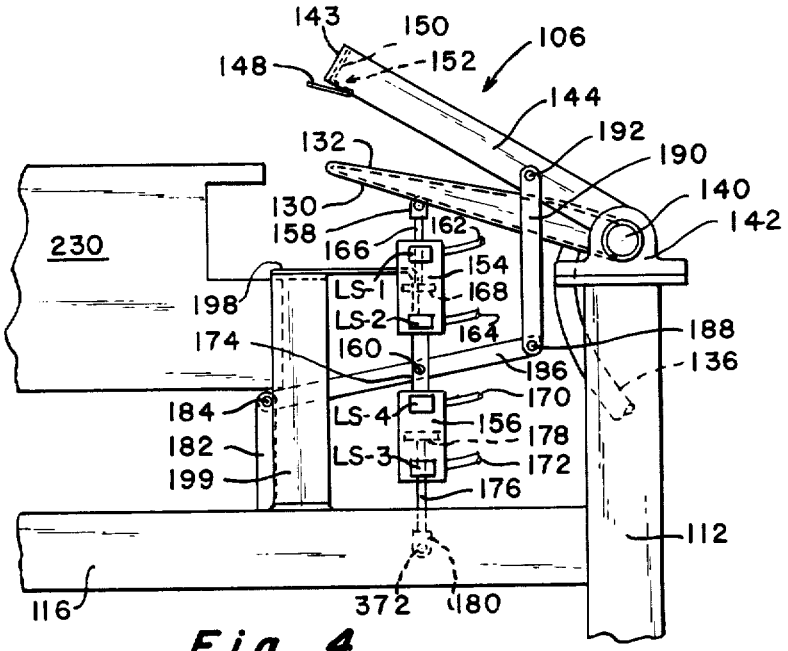
FIG. 4 shows a detailed side elevational view of the loading bar and clamping means actuating assembly.

The loading bar assembly 104 and clamping bar assembly 106 are best shown in FIGS. 1 and 4 and the coordinated operation of these two assemblies is best shown in FIGS. 5 through 8.

Turning first to FIGS. 1 and 4, the loading bar assembly 103 is comprised of a hollow, tubular bar 130 which extends across a substantial portion of the length of the device 100. In the preferred embodiment as shown in FIG. 4, the tubular loading bar 130 has a substantially triangular cross-sectional shape. However, it is essential only that the tubular loading bar 130 can be provided with a substantially flat upper surface 132 for supporting the upper portion of drapery panels P to which the buckram material is to be applied.

The tubular loading bar is secured to a shaft 140 by any convenient means such as by welding and the shaft 140 in turn, is pivotally retained on the frame 102 by means of support brackets 142.

The tubular loading bar 130 is constructed so that a chamber is effectively formed inside thereof. A plurality of vacuum ports 134 are provided within the upper surface 132 specifically along the forward, unsecured side and the tubular chamber 130 is connected, by means of a flexible conduit 136, to a vacuum source 138, such as a Tek-Matic Vacuum Model #T-6, 115v., 3.2 amp, sold by Tek-Matic Sales Co., West Inglewood, New Jersey. Thus, when the vacuum source 138 is energized a vacuum can be applied to the vacuum ports 134. This can be accomplished by suitable switching devices described hereinafter. When a drapery panel is placed on the upper surface 132 of the tubular loading bar 130, vacuum from the source 138 will serve to hold the drapery panel in the position selected by the operator.

While the vacuum holding system just described is preferred, other types of holding arrangements such as pneumatically or mechanically operated side clamps, could equally well be used.

The clamp assembly 106 is comprised of a front member 143 which extends along the length of the device 100 and spaced from the forward unsecured side of the loading bar 130. Attached, as by welding, at each end of the front member 143 are relatively short side members 144 and 145 which extend perpendicularly away from member 143 toward shaft 140. Each of the side members 144 and 145 is secured, as by welding, or any other convenient technique to a bushing 146 which is pivotally mounted on shaft 140 on either side of the tubular loading bar 130. Attached to the front member 143 of the clamp assembly 106 is a clamp foot 148 which extends along the length of the front member 143. As is best seen in FIG. 4, a portion of the clamp foot 148 is bent back over onto itself and is attached, as by welding, to the front member 143 so that the clamp foot 148 is provided with a degree of resiliency. The top portions of the clamp foot 148 together with the interior wall 150 of the front member 143 form a recessed area generally indicated at 152.

Movement of loading bar 130 and clamp assembly 106 are controlled by identical drive systems at each end of the load bar 130 and clamp assembly 106 as is shown in FIG. 1. Since each drive system is identical, the following discussion will deal with only one side.

Therefore, in referring to the left side, movement of the loading bar 130 and the clamp assembly is effected by air cylinders 154 and 156 respectively. As can be seen in FIG. 4, air cylinder 154 is pivotally secured at one end to the tubular loading bar at 130 by any convenient means such as clevis 158 and is likewise pivotally secured at its opposite end to a pin 160. In addition, air cylinder 154 is provided with two air ports 162 and 164. The air cylinder itself is provided with a drive shaft 166 which is connected to an internal piston 168 with the drive shaft 166 being connected to the cleavis 158.

Air cylinder 156 which controls the movement of the clamp assembly 106 is provided with air ports 170 and 172 and has its fixed end shaft 174 also attached to pin 160 while the drive shaft 176, which is secured to the internal drive piston 178, is pivotally secured to the frame member 116 by any convenient means such as clevis 180.

As will be more completely discussed hereinafter, each air cylinder 154 and 156 operates two switches which form part of the control circuit of the present invention. Specifically, the internal piston 168 of cylinder 154 operates switches LS-1 and LS-2, as it moves within cylinder 154 whereas the internal piston 178 of cylinder 156 operates switches LS-3 and LS-4.

A linkage structure is included as part of the drive system for the loading bar 130 and clamp assembly 106. This linkage structure includes a support link 182, secured as by welding to frame member 116. A drive link 186 is pivotally connected by means of a pin 184 to the support link 182 and the drive link 186 is in turn pivotally connected by pin 188 to a vertical drive link 190 which is pivotally connected by means of pin 192 to the clamp arm 144.

Since the vertical drive connection 182 is fixedly attached to the frame member 116, it will be appreciated that when cylinder 156 is energized, the drive linkage 186 will be raised and lowered according to the way in which cylinder 156 is energized (i.e., raised by applying air to port 170 and lowered by applying air to port 172). As the drive linkage 186 is raised or moved in a counter-clockwise direction by cylinder 156, cylinder 154 will be moved vertically due to its being connected to the drive linkage 186 by means of the pin 160 along with cylinder 156. Likewise, the clamp arm 144 will be raised vertically in a clockwise direction due to the action of the vertical drive linkage 190. When the action of air cylinder 156 is reversed, drive linkage 186 will be moved in a counter-clockwise direction causing the air cylinder 154, drive linkage 190 and the clamp arm 144 will all move in a downward direction.

Since the drive arm 166 of the cylinder 154 is connected to the tubular loading bar 130, when air cylinder 154 is energized by air being supplied to port 164 the loading bar 130 will be caused to move upwardly in a clockwise direction. Likewise, when the cylinder is energized by air being supplied via port 162, the load bar 130 will be lowered. While air cylinders are preferably used, it should be understood that any other suitable driving mechanism for the loading bar 130 and the clamp assembly 106 could be equally as well used.

Figure 5:
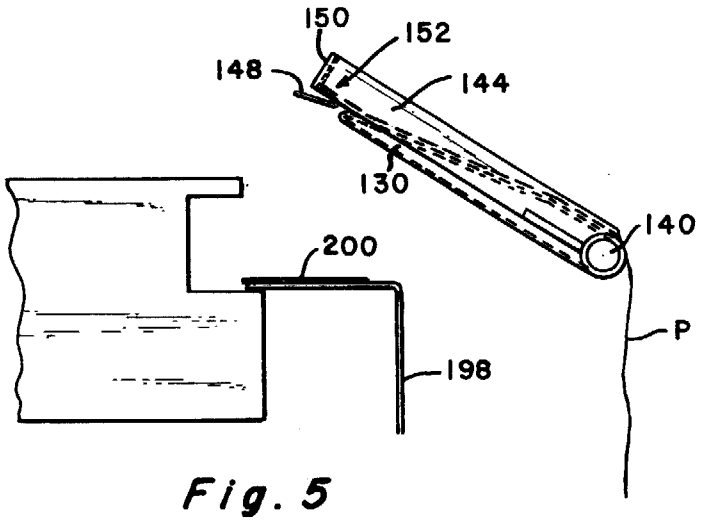
FIG. 5 shows a diagrammatic view of the loading bar and clamp assembly in a raised loading position.

Turning now to FIGS. 5 through 8, the loading bar 130 and the clamp arm 144 are both shown in their raised or load position in FIG. 5. A drapery panel, P, has been placed on the loading bar 130 and extends in to the recessed area 152 formed by the clamp foot 148 and interior wall 150. It will be noted that only part of the upper portion of the panel P is supported by the loading bar 130 unlike many prior art devices which required the entire panel be supported during the sewing operation.

Figure 6:
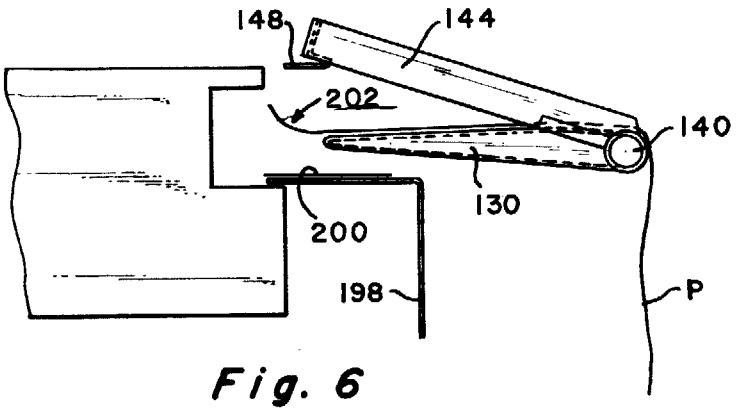
FIG. 6 shows the loading bar in an intermediary position between loading and sewing positions.

In FIG. 6, the loading bar 130 has been lowered from its load position toward the working platform 198, attached to frame member 116 and 118 by a support member 199. A strip of buckram 200 is supported by the platform 198 and the platform 198 provides the surface against which the panel P and the buckram 200 are clamped by clamp assembly 106. As will be more fully discussed hereinafter, the loading bar 130 is lowered in advance of the clamp arm 144. This assures that the portion of the drapery panel P which had been inserted into the recess 152 will be removed from that recess 152 as is shown in FIG. 6 at 202. Further, as shown in FIG. 7, the end portion of the panel P which was in the recess 152 will extend beyond the edge of the strip of buckram 200 as indicated at 204 when clamp foot 148 is in its clamping position against work surface 198.

In many instances, top edge of a drapery panel may be uneven. The strip of buckram, however, has a square straight edge. Thus, is is desirable to trim a portion of the panel P during the sewing operation so that the edge of the panel is equally as straight as the buckram. FIG. 7 also shows the clamped sewing position for both the loading bar assembly 104 and the clamping assembly 106 with the clamp foot 148 securely holding the top edge of the panel P against the buckram 200 on the support work table 198.

Referring again to FIG. 1, a supply of buckram material, generally indicated at 206, is provided on the right end of the apparatus. The traversing sewing assembly, generally indicated at 108 in FIG. 1, moves from left to right in FIG. 1 during the sewing operation so that when the sewing operation is completed, the sewing machine will occupy a sew complete position at the right side of the apparatus. In order to remove a panel after sewing, it is, of course, necessary to sever each finished panel from the supply of buckram 206. This is accomplished by means of a cutting assembly generally indicated at 208.

Figure 7:
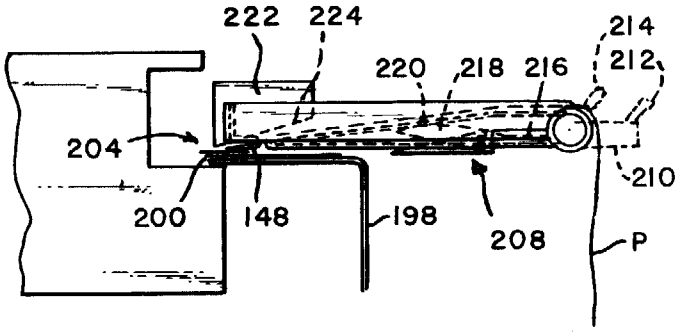
FIG. 7 shows a diagrammatic view of the loading bar and clamping assembly in the operating clamped position.
Figure 8:
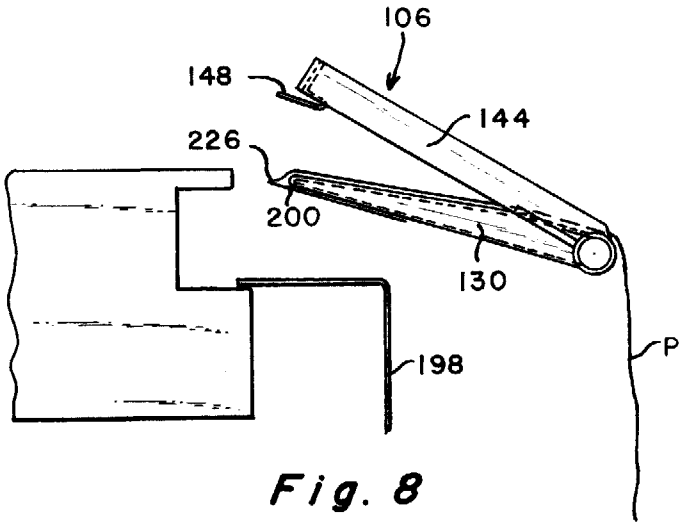
FIG. 8 shows diagrammatically the loading bar in an intermediary raised position following the sewing cycle.

The cutter assembly 208 is shown in FIG. 7 in phantom and is comprised of an air cylinder 210 having ports 212 and 214 and a drive shaft 216 which is secured to a pair of scissors 218 held open by any convenient means such as a spring (not shown). A raised projection 220 is provided on the scissors 218 for cooperating with a camming 222 having a camming surface 224. As the air cylinder 210 moves the scissors 218 forward during the cutting cycle, the camming projection 220 will contact the camming surface 224 which closes the scissors 218. As the scissors 218 continue to move forward, they become completely closed so that the supply of buckram and the stitching on the panel are severed from the buckram supply 206 and the thread in the sewing machine. When this forward position of the scissors 218 is reached a switch LS-8 shown in FIG. 1 will be tripped, generating a signal indicating that the cutter assembly 208 has completed a cutting cycle.

Following the cutting cycle, the clamp assembly 106 need only be raised out of its clamping position for the doffing means 110 to remove the complete panel from the device. Since the returning of the loading bar 130 and clamp assembly 106 to their initial loading position can be accomplished while the sewing machine is returning to its initial start or home position and while doffing is proceeding, the next loading operation of a subsequent panel can be intitialed as soon as the last panel is removed from the loading bar 130 and simultaneously with the return function of the sewing machine without any hazard to the operator.

Following the completion of the sewing and cutting cycles, the clamp assembly 106 and specifically the clamp arm 144 will be raised so that the unclamped panel may be removed or doffed. As the clamp is raised, however, and until doffing removes the panel, the panel P will remain.

The sewing assembly, generally indicated at 108 in FIG. 1, is comprised of a sewing machine 230, a suitable drive motor 232, a clutch-brake assembly 234 and a gear box 236 with each of these being mounted by any conventional means on a movable carriage 238. The motor 232 is connected by means of a drive shaft 240 and drive belt 242 to a drive shaft 244. One end of the drive shaft 244 is supported by the gear box 236, while the other end is pivotally supported within bracket 246 which is also secured by any suitable means to the movable carriage 238. The drive shaft 244 is also conventionally connected to the sewing machine as by means of a drive belt arrangement 248.

Referring now to FIG. 3, the gear box is also connected to a driving gear 250 by means of a drive shaft 252. The gear 250 is in turn drivingly engaged with a rack 254 supported by means of a support rail 256 suitably fixedly attached to frame 102.

The movable carriage 238 is supported, as by welding, shown at 258 to a vertical support wall 260 which is, in turn, secured, as by welding, to slidable bushings 262 which are slidably retained on rails 264. The rails 264 are attached to and supported by a vertical frame member 266 connected to frame member 268 which is connected to the rear legs 114.

As will be evident from FIG. 1, the movable carriage 238 is slidably mounted such that it can traverse the complete width of the drapery panel P placed in the device. This allows the sewing operation to take place as the carriage 238 is moved across the panel P. As shown in FIG. 1, the movable carriage 238 and sewing machine 230 are shown in their initial starting or home position.

As was pointed out above, during the sewing operation the top edge of the drapery panel P is trimmed by the sewing machine 230 which includes a conventional cutting attachment therewith and collected by trim collector 275 comprised of a flexible conduit 270, aperture 272, an air cylinder 274 and a cover plate 276. During the sewing operation, the vacuum supplied by vacuum source 138 is switched from the loading bar 130 and flexible conduit 136 to a flexible conduit 270 connected to an aperture 272 in the movable carriage 238. The opening and closing of aperture 272 is controlled by an air cylinder 274 which is of conventional design. The drive shaft of cylinder 274 is connected to a plate 276 sufficiently sized so as to completely cover the aperture 272. During the sewing cycle, cylinder 274 is energized so that the plate 276 is removed from its closed position over aperture 272 providing a direct access through the flexible conduit 270 into vacuum source 138. The aperture 272 is positioned so that the trimmings resulting during the sewing operation can be immediately removed from the area of sewing machine 230 and deposited within the vacuum source 138 for disposal at a later time.

The doffing assembly, generally indicated in FIG. 1 at 110, and shown in FIGS. 1, 3, 11 and 12 is comprised of pivotable rods mounted to a carriage assembly which traverses in a direction perpendicular to the movement of the sewing machine so as to cause the drapery panel with the buckram attached to be pulled loose from the loading bar 130 and moved over the top of the drapery truck 122 as shown in FIG. 3. Since the doffing assembly on each side of the device 100 is the same, the following description will concern itself only with the doffing apparatus shown on the left-hand side of FIG. 1.

Turning now to FIGS. 1 and 3, the doffing drive motor, indicated at 280, is mounted on frame member 268 by means of a support platform 282 which is provided with support projections 284. The drive shaft of the doffing drive motor 280 is connected to a pulley 286 around which a drive belt 288 is connected. The drive belt 288 is in turn connected in a driving relationship with a drive shaft 290 which serves to drive the doffing assembly on each side of the device 100.

Turning to FIG. 3, the drive shaft 290 is connected to a drive wheel 292 which together with drive wheel 294 rotatably secured to the front vertical leg 112, support and drive a drive chain 296. As will be noted in FIG. 1, the drive shaft 290 is rotatably secured within brackets 298 and 300 each of which is secured to the rear frame member 120 by any convenient means such as bolts 302.

Figures 11, 12:
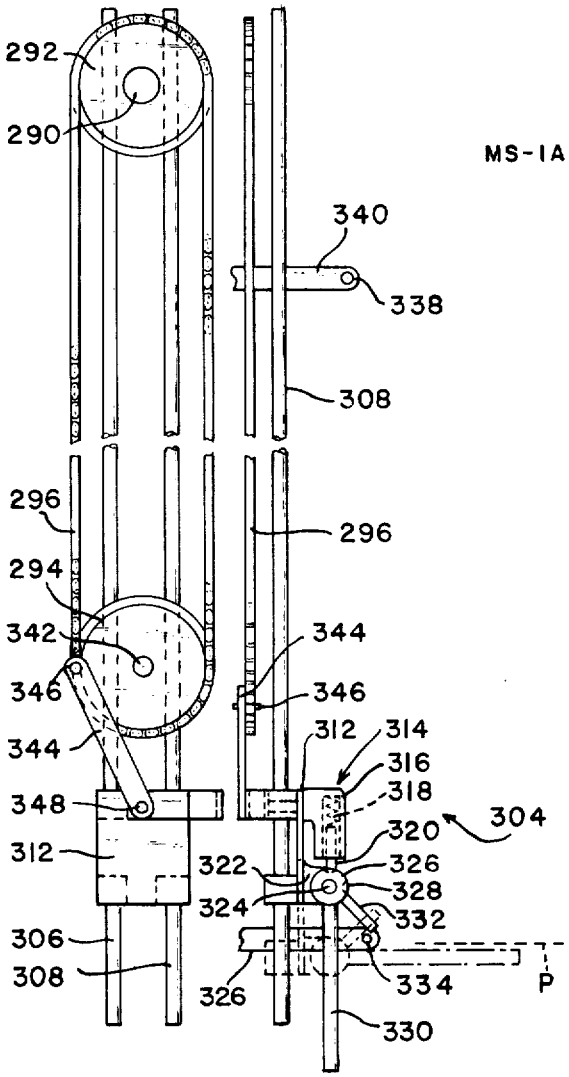
FIG. 11 is a diagrammatic side elevational view of a portion of the drive mechanism for the doffing assembly.
FIG. 12 is a diagrammatic plan view of a portion of the doffing assembly.

The doffing mechanism itself, generally indicated at 304 in FIG. 12, is slidably mounted on guide rails 306 and 308 by means of slide bushings 310 and guide rails 306 and 308 are attached to the main frame 102 by any convenient means. Mounted to the slide bushings 310 is a mounting plate 312 which serves to support a spring detent device 314 comprised of a housing 316 containing a spring 318 and a detent arm 320. Also, connected to the mounting plate 312 is a mounting bracket 322 which in turn supports a shaft 324. Rotatably held on shaft 324 is a mounting collar 326 which is provided with two detents 328 offset from each other by 90°. Detents 328 together with the detent arm 320 serve to maintain the position of the doffing arm 330.

The doffing arm 330 is fixed to the mounting collar 326 by any convenient means such as welding as is a positioning arm 332. However, the doffing arm 330 and positioning arm 332 are mounted on collar 326 at different elevations with the doffing arm 330 being at a higher elevation than the positioning arm 332 as is shown in dotted lines in FIG. 3.

As shown in FIG. 12, the solid line drawing of the doffing arm 330 and the positioning arm 332 shows the position of the doffing arm as it is moving toward the front of the machine during the last stages of the doffing cycle after the top portion of the previous panel has been redeposited on the truck 122. When the doffing mechanism 304 passes the position shown in FIG. 12, the positioning arm 332 being at a lower elevation on collar 326 will come into contact with the front positioning pin 334 secured to frame 102 by means of a bracket 336. Also, shown in FIG. 12 is a rear positioning bar 338 and a rear mounting bracket 340.

As the doffing assembly 304 is moved in a forward direction during the initial stages of the doffing cycle, the positioning arm 332 will come into contact with the positioning bar 334 and further forward motion of the doffing mechanism 304 will cause the doffing arm 330 to be pivoted to the position as shown in phantom lines in FIG. 12. As the positioning arm 332 is pushed against the positioning bar 334, the effect of the detent spring 318 will be overcome and detent arm 320 will be moved into housing 316 allowing the mounting collar 326 to rotate on the supporting shaft 324. When the doffing arm 330 is in the position as shown in phantom lines, the second detent 328 will be engaged by the detent arm 320 causing the doffing arm 330 to remain in the position as shown in phantom lines in FIG. 12. During the latter portion of the doffing cycle, discussed hereinafter, the doffing arm 330 will be moved rearwardly while positioned as shown in phantom lines in FIG. 12. Since the doffing arm 330 is mounted at a higher elevation on collar 326 than the positioning arm 332, the doffing arm 330 will pass over the positioning bar 334. As the positioning arm 332 approaches the rear positioning bar 338 the positioning arm will come into contact with the rear positioning bar 338 and further rearward movement will cause the doffing 330 to be returned to the position shown in solid lines in FIG. 12.

The drive means for the doffing mechanism 304 is comprised of a drive chain 296 which is supported by means of the rear and front drive wheels 292 and 294 as indicated previously. The rear drive wheel 292 is supported on the drive shaft 290, while the front drive wheel 294 is rotatably mounted on the frame member 116 as by means of a stud shaft 342. Connected between the chain 296 and the mounting plate 312 is a drive linkage 344 one end of which is pivotably connected to the chain 296 as by means of pin 346 with the other end being connected to the mounting plate 312 by means of pin 348.

Thus, in operation, when the doffing drive motor 280 is turned on and the drive shaft 290 rotated, drive chain 296 is moved thereby moving drive linkage 344 which, in turn, causes the mounting plate 312 to slide on bushings 310 along the guide rails 306 and 308. When the doffing mechanism 304 is in its most forward position adjacent switch LS-9, the pin 346 connecting the drive linkage 344 to the drive chain 296 will be in the center of the forward edge of the drive wheel 294. Because the drive linkage 344 is pivotally attached both to the drive chain 296 and to the mounting plate 312, the movement of pin 346 around drive wheels 294 and 292 is compensated for, thus allowing the doffing mechanism 312 to continuously move in a straight line along rails 306 and 308.

Turning now to FIGS. 1 and 2, the supply of buckram generally indicated at 206 is comprised of a roll of buckram 350 which is supported by a mounting bracket 352 attached to the main frame member 118 as by bolts 354. When the buckram material 200 leaves the supply roll 350, it passes under a spring loaded tensioning device, generally indicated at 356, beneath a weighted tensioning device 358, which takes up any slack in the buckram created when the movable carriage 238 stops at the home position, and finally through a guide 360 mounted to the work surface 198. The spring loaded tensioning device 356 as shown in FIG. 2 is comprised of a bottom plate member 362 secured to brackets 352 and a top plate member 364 held in place on top of the bottom plate member 362 by means of a bolt 366 extending vertically through the bottom member 362, a spring 368, washer 370 and a nut 372. The weighted tensioning device 358 is pivotally attached to the spring loaded tensioning device 356 as, for example, between the bolts 366 to rod 374.

Figure 9:
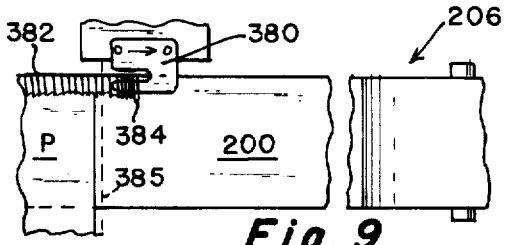
FIG. 9 diagrammatically shows the sewing machine needle plate with respect to the strip of buckram following the termination of a sewing cycle.

Turning now to FIG. 9, the sewing operation is shown as being completed with the sewing machine needle plate 380 having moved beyond the right-hand edge of the panel P, but positioned over a portion of the strip of buckram 200. The overedge stitching indicated at 382 likewise extends beyond the edge of the panel P and onto the strip of buckram 200. When the sewing machine has completed this cycle, the traversing movement of the sewing machine is slowed prior to the stopping of the overedge needle action which allows an excess of thread to be deposited through the buckram and over the needle plate 380 as at 384. Following the cutting operation by the cutter 208 which will sever the buckram 200 and overedge stitching 382 substantially along dotted line 385, the panel can be removed from the loading bar 130 leaving the sewing machine still in its far right position and with the needle plate 380 still positioned over the strip of buckram 200. However, the stitching 382 and the reinforced portion of that stitching as at 384 in effect forms a tunnel around the leg portion of the needle plate 380. Thus, when the sewing machine 230 is moved back to its home position, as is shown in FIG. 1, the needle plate 380 will pull a supply of buckram from the roll 350 thereby positioning a new piece of buckram in place on the work surface 198 in preparation for receiving the next panel.

Figure 13:
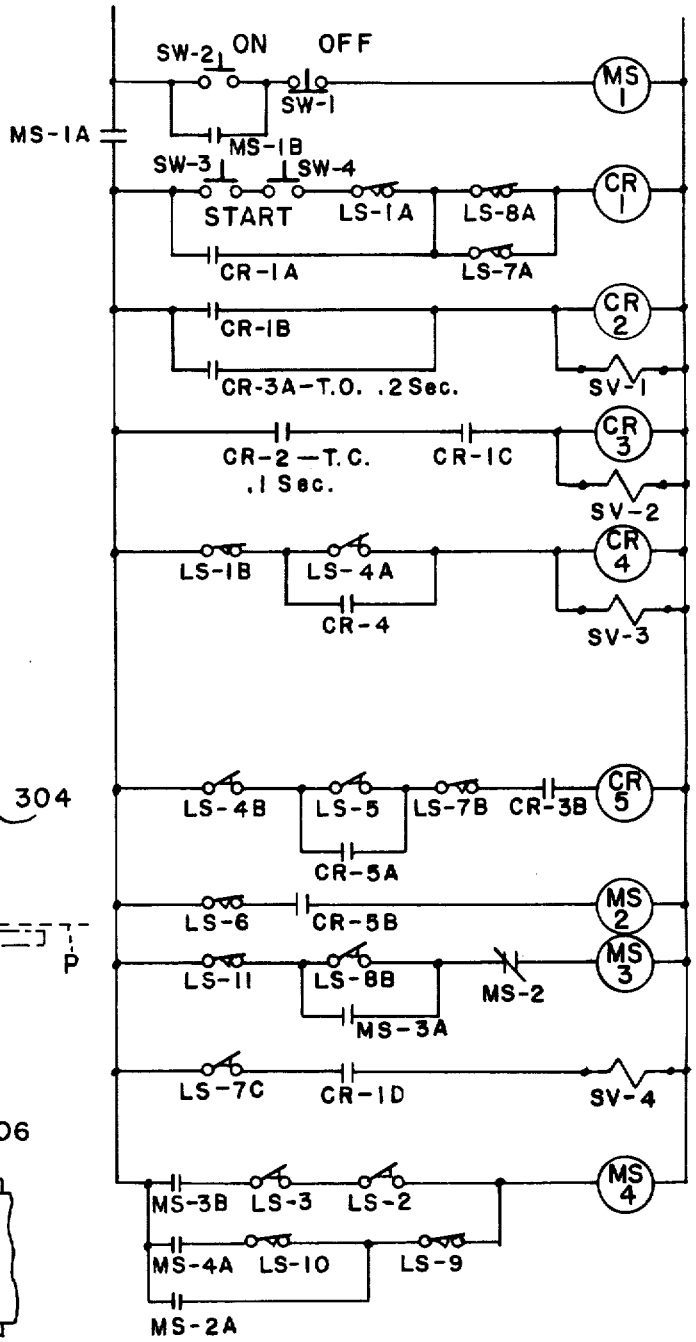
FIG. 13 shows the control circuit for the exemplary embodiment of the present invention disclosed herein.

The control circuit for the present invention is set forth in FIG. 13 and is comprised of motor starter MS1 through MS4 and their respective contacts control relays CR1 through CR5 and their respective contacts, switches LS-1 through LS-11 and solenoid valves SV-1 through SV-4.

The main off switch is identified as SW-1 while the start switch which is a momentary push button is identified as SW-2. Together, SW-1 and SW-2 control the energization and starting of the device and also serve to directly turn on the vacuum source 138. The contact MS-1B serves to latch motor starter MS1 in an on mode once push button start switch SW-2 is depressed by the operator. The contact MS-1A provides power to the rest of the circuit as long as the motor starter MS1 remains energized. Thus, at the point in the cycle when SW-2 is pushed the vacuum motor is on and a vacuum is being supplied to the load bar 130. The load bar 130 and the clamp assembly 106 are in a raised or load position, the clutch-brake assembly 234 is disengaged, the sewing machine motor 232 is off, and the cutter assembly is in an off condition. Also, the doff assembly drive motor 280 is off and the doffing mechanism 304 is positioned adjacent the location of switch LS-10.

Figure 10:
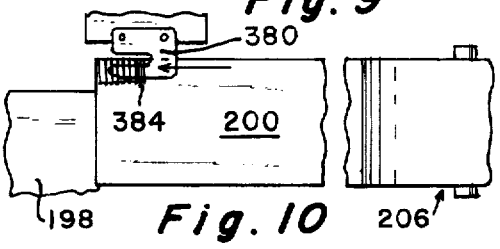
FIG. 10 diagrammatically shows the position of a sewing plate and the strip of buckram just prior to the sewing machine being reversed back to its home position.

The device is now in condition to receive a panel. Following the loading and proper adjusting of the panel by the operator, the start switches SW-3 and SW-4 must both be depressed by the operator. Two start switches which are separated from each other have been used as a safety feature so that the operator is required to employ both hands to initiate a sew cycle. The switch LS-1A, part of switch LS-1 attached to cylinder 154, is a normally open switch which is held closed by the fact the load bar 130 is in the load position. It should be noted that switches LS-1 through LS-4 are preferably magnetic switches operable by the respective piston in air cylinders 154 and 156. Control relay CR1 will be energized following actuation of switches SW-3 and SW-4 if the load bar 130 is raised and if switches LS-7A and LS-8 are not opened. Switch LS-7A is opened by the movable carriage 238 when the movable carriage 238 arrives at its far right position. Since the carriage is in its home position at start-up, switch LS-7A will remain closed as is shown in FIG. 10. Switch LS-8A is only opened by the cutter mechanism following the cutting cycle. Therefore, at the beginning of a cycle, when the above conditions have been met, the depressing of switches SW-3 and SW-4 by the operator will complete a circuit through switch LS-1A and either switch LS-7A or LS-8A so as to energize the control relay CR1. Once control relay CR1 is energized, a latching circuit is provided around the start push buttons SW-3 and SW-4 by the contact CR-1A.

When the sewing machine has completed its traverse so that the movable carriage 238 will cause the switches LS-7A to open and the cutter assembly 208 has completed its cycle causing the switch LS-8A to open, the control relay CR1 will be deenergized.

With control relay CR1 energized, contacts CR-1B, 1C and 1D are closed. Contacts CR-1B energize control relay CR2 and the solenoid valve SV-1. The solenoid valve SV-1 controls the air to the air cylinder 154 which controls the actuation of the loading bar 130. Thus, when control relay CR2 is energized, the loading bar 130 is caused to be lowered from its loading position toward the sewing position as discussed hereinbefore.

It should also be noted, that a latching circuit is provided around the contact CR-1B for controlling the actuation of control relay CR2 and comprises the contact CR-3A. Contact CR-3A is also a time delay device, but it is the opening of the contacts which is delayed for 0.2 second. Following a sewing cycle when the loading bar 130 and clamp assembly 106 are about to be raised to their load positions, the clamp assembly 106 will be moved by cylinder 156 in advance of the loading bar 130 due to the delay in the opening of contact CR-3A.

Control relay CR3 and solenoid valve SV-3 control the actuation of air cylinder 156 when contact CR-1C is closed and when time delay contact CR-2 T.C. closes. The time delay preferred for contact CR-2 T.C. is 0.1 second although the exact time delay may be varied. Thus, CR3 and SV-2 are engergized 0.1 second after CR2 is energized. This allows cylinder 156 to effect the clamping relationship between the loading bar 130 and the clamp assembly 106 in their lowered sewing position only after the loading bar 130 has been lowered by cylinder 154.

Control relay CR4 and solenoid valve SV-3 control the switching of the vacuum source from the loading bar 130 to the aperture 272 located in the movable carriage 238 adjacent sewing machine 230. During the loading of a panel, the vacuum source 138 must be connected to the loading bar 130 and should only be switched to the aperture 272 after the clamp assembly 106 is in its clamping position so that the panel P and the strip of buckram 200 are securely held together in proper alignment. As is shown in FIG. 10, switch LS-1B, part of switch LS-1 and a normally closed switch, is located on air cylinder 154 which controls the raising and lowering of the loading bar 130. Switch LS-4 is a normally open switch and is located on the top of air cylinder 156 which controls the actuation of the clamp assembly 106. When cylinder 154 is energized by solenoid valve SV-1, the piston 168 is moved in a downward direction thereby allowing the contact LS-1B to close. However, the control relay CR4 and solenoid SV-3 will not be energized until switch LS-4 is closed which will occur only when the piston 178 is retracted completely within cylinder 156 when the clamp assembly 106 is closed. Thus, only when the loading bar 130 and clamp assembly 106 are in a clamped sewing position, will the control relay CR4 and the solenoid valve SV-3 become energized causing vacuum to be applied to the aperture 272.

Control relay CR5 controls the actuation of the clutch brake assembly 234. Control relay CR5 is energized when contact CR-3B, switch LS-4, switch LS-5 and LS-7B are all closed. LS-4 is closed when the clamp assembly 106 is in its clamping position. Switch LS-5 is a normally open switch which is closed when the movable carriage 238 is in its initial or home position. Switch LS-7B is a normally closed switch which is opened by the movable carriage 238 when the sewing machine 230 has finished the sewing cycle and the movable carriabge 238 has traversed across the machine to a position on the right-hand side.

The contact CR-3B will be closed when the control relay CR3 is energized which assures that the clutch-brake assembly 234 will not be energized unless the clamp assembly 106 is lowered in a clamping position. When these conditions are all fulfilled, the control relay CR5 will be energized. In addition, the switch LS-5 is provided with latching contact CR-5A so that the clutch-brake assembly 234 remains energized even after the movable carriage 238 leaves its home position.

The motor control starter MS2 controls the forward actuation of the motor 232 whereas the motor control starter MS3 controls the reverse mode actuation of motor 232. MS2 will cause motor 232 to be energized in a forward mode as long as the normally closed switch LS-6 remains closed and the clutch-brake contact CR-5B is closed. Thus, the movable carriage will only be moved forward across the panel if the sewing machine is not in a far right position, at which point the switch LS-6 would be opened, and that the clutch-brake assembly 234 be energized by control relay CR5. Therefore, having energized the clutch-brake assembly 234, MS2 will place the sewing machine motor 232 in a forward mode of operation thereby affecting simultaneous sewing by the sewing machine 230 and the traversing of the movable carriage 238 across the device 100.

Motor starter MS3 is actuated by switch LS-11, switch LS-8B and by contacts MS2 (NOT). Switch LS-11 is a normally closed switch which is opened when the movable carriage 238 returns to its home or initial position. Switch LS-8B is closed by the cutter assembly 208 at the completion of the cutting stroke. Therefore, at the completion of the cutting cycle, with the carriage 238 still in its far right position, MS3 will place motor 232 in a reverse mode which will be terminated when switch LS-11 is opened upon the returning of carriage 238 to the home position. In addition, a latching circuit is provided by contact MS-3A which is closed once the motor starter MS3 is energized.

Summarizing the operation, therefore, of motor starters MS2 and MS3, MS2 will be energized causing the forward motion of the movable carriage 238 and stitching by sewing machine 230 when the carriage 238 is in its home position and the clutch-brake assembly 234 has been energized by control relay CR5. When the movable carriage 238 arrives at a position adjacent switch LS-6, switch LS-6 will be opened deenergizing motor starter MS2. However, since the clutch-brake assembly 234 has not yet been shifted from a clutching function to a braking function, the movable carriage 238 continues to coast in a forward direction. The drive gear 250 continues to rotate causing continued rotation of the drive shaft 244. Since the clutch-brake assembly 234 is still acting in a clutch mode, the continued rotation of drive shaft 244 will continue to move the needle in the sewing machine 230 during the coasting process. Only when switch LS-7 is closed by the coasting movable carriage 238 will switch LS-7B to be opened causing the control relay CR5 to be deenergized. When CR5 is deenergized, the clutch-brake assembly 234 is shifted out of the clutch mode causing the brake to be applied which stops the coasting of the movable carriage 238 and likewise further stitching by the sewing machine 230.

When switch LS-7 is actuated, switches LS-7A and LS-7B are opened and LS-7C is closed. Since there has been no actuation yet of the cutting assembly 208, the control relay CR1 continues to be energized through contact LS-8A assuring that contact CR-1D in the current controlling solenoid valve SV-4 remains closed. When switch LS-7C is closed, solenoid valve SV-4 is energized which energizes the buckram cutting cylinder 210 and actuates the cutter assembly 208. When the buckram has been severed, the scissors 218 will have actuated switch LS-8 causing contacts LS-8A to open and causing contacts LS-8B to close. Since the movable carriage 238 is in its far right-hand position following the completion of the sewing cycle, switch LS-7A was previously opened and contact LS-8A has just been opened. Therefore, the control relay CR1 is deenergized which opens contacts CR-1A, CR-1B, CR-1C and CR-1D. The opening of contacts CR-1A removes the latching circuit around the starting switches SW-3 and SW-4 so that those switches would again have to be depressed in order to again energize control relay CR1.

The opening of contact CR-1B will bring in to circuit the timed delayed opening contact CR-3A which will delay the deenergization of control relay CR2 and likewise the deactivation of solenoid valve SV-1. It will be recalled that control relay CR2 and valve SV-1 control the actuation of air cylinder 154 which controls the raising and lowering of the loading bar 130. Likewise, the opening of contact CR-1C will immediately deenergized control relay CR3 and solenoid valve SV-2, thereby reversing cylinder 156 to raise the clamp assembly 106 from its clamping position. Since there is a time delay of 0.2 second before the control relay CR2 is deenergized, the clamping assembly 106 will be raised in advance of the loading bar 130 allowing time for the panel P to be doffed from the loading bar 130.

The opening of contact CR-1D will immediately deenergize solenoid valve SV-4 thereby allowing the scissors 218 to return to their initial home position back within the cutter assembly 208.

Since the motor starter MS2 has already been deenergized, completion of the cutting cycle will also cause switch LS-8B to be closed which in turn energizes motor starter MS3. This causes the sewing machine motor 232 to be driven in a reverse direction thereby moving the carriage 238 back to its home position. When that home position is reached, the movable carriage 238 will cause the normally closed switch LS-11 to be opened, thereby deenergizing motor starter MS3 and the sewing machine motor 232.

Motor starter MS4 controls the actuation of the doffing motor 280 and is actuated along with motor starters MS2 or MS3 depending upon the positioning of switches LS-2, LS-3 LS-9 and LS-10. Switches LS-2 and LS-3 are normally open switches and will be closed, respectively, when the clamping assembly 106 is raised to a loading position and when the loading bar remains in its lowered sewing position. Switches LS-9 and LS-10 are normally closed switches and each will be respectively opened when the doffing mechanism 304 is positioned adjacent that respective switch.

Motor starter MS4 will, therefore, be energized when motor 232 is energized in the forward mode (when contact MS-2A is closed) so long as the doffing mechanism has not arrived at a position adjacent switch LS-9. Should the doffing mechanism 304 arrive at a position adjacent switch LS-9 during this period, switch LS-9 would be opened, and switch MS-4A would be deenergized turning off motor 280 and stopping the doffing cycle at that point.

Doffing can proceed during the reversing of motor 232 when contact MS-3B is closed so long as the clamp assembly 106 has been raised which closes switch LS-3. This is essential since the doffing mechanism 304 would not be able to remove a panel that remained clamped. In addition, the loading bar 130 moves to a partly raised position between the sew and load positions so that the panel P is free to be doffed. Once MS4 is energized, however, a latching circuit is provided around the line containing contact MS-3B, LS-3 and LS-2. That latching circuit is comprised of contact MS-4A, the normally closed switch LS-10 and the normally closed switch LS-9. Thus, during the return of the movable carriage 238 to its initial, home position, as shown in FIG. 1, the doffing motor 280 will continue to operate until the doffing mechanism 304 has arrived at a position adjacent switch LS-10.

Figure 14:
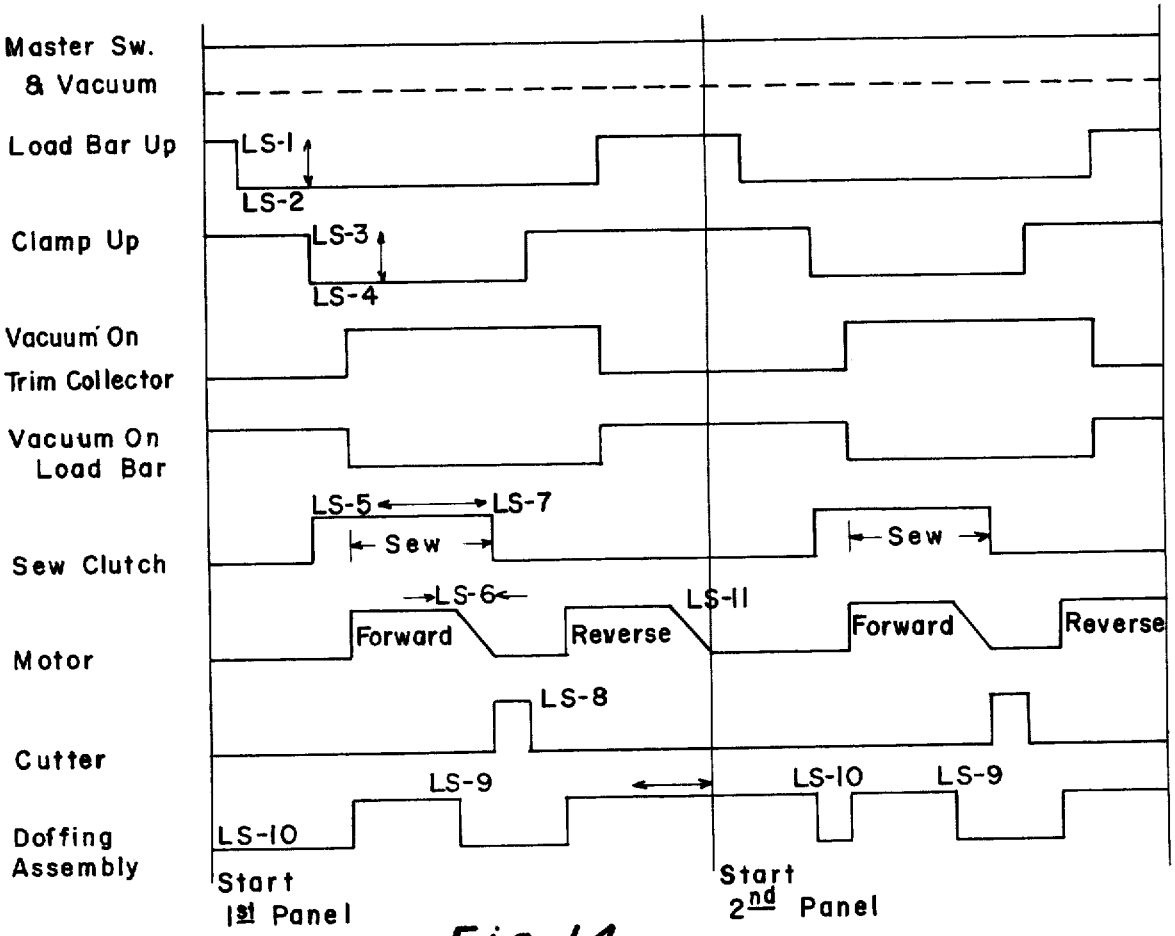
FIG. 14 shows a timing diagram for the sequential steps through which the present apparatus operates.

FIG. 14 represents a time diagram and graphically sets forth the sequence of steps used with respect to the present invention as is more fully explained in the operation of the present invention as follows:

When the master switch SW1 is on, a vacuum will be applied to the load bar 130 and will be disconnected from the trim collector. The load bar 130 and clamp assembly 106 will be in a raised or loading position, the clutch-brake assembly 234 will be disengaged, the sew motor 232 will be in its initial, home position. Likewise, the doff assembly 110 will be in an off mode stopped adjacent switch LS-10.

After a drapery panel carrier 122 has been placed in position beneath the apparatus, the operator will grasp the upper portion of a panel P and slide that upper portion onto the load bar 130. Since the vacuum on the load bar 130 is energized, the drapery panel P will be held in place on the loading bar 130 by means of the vacuum. As indicated previously, the amount of vacuum employed should be sufficient to hold the panel on the loading bar 130 when in its raised position, but not strong enough to prevent the operator from adjusting the position of the panel once placed on the load bar 130. The top edge of the panel will thereafter be adjusted so as to be aligned within the recess 152 which assures proper alignment of the drapery panel P on the loading bar 130 and also assures that the proper length of material has been placed on the loading bar 130 so that a portion of the drapery panel P will extend beyond the edge of the buckram material 200.

Following the proper placement of the panel on the load bar 130 and within the alignment portion of the clamp assembly 106, the operator will initiate the sewing cycle by depressing both start switches SW-3 and SW-4 simultaneously. As indicated previously, two start switches have been used and spaced widely apart so that the operator of necessity will have to use both hands thus assuring that the hands of the operator will have been withdrawn from the apparatus prior to the sewing cycle. As indicated with respect to the discussion of the control circuit, the loading bar 130 will be initially lowered in advance of the clamping assembly 106 which will begin its descent after an appropriate time delay. This allows the leading edge of the drapery panel P which had been placed in the alignment portion of the clamping assembly 106 to be effectively freed from that alignment portion of the clamping assembly and be in position to be clamped by the clamping assembly on top of the strip of buckram 200. After the loading bar 130 has been lowered into its sew position and the clamping assembly 106 has been lowered into a clamping position, the clutch-brake assembly 234 will be engaged so that when the motor 232 is energized, the sewing machine 230 will simultaneously begin a traversing motion across the apparatus and sew the drapery panel P and the buckram together.

Following the engagement of clutch-brake assembly 234, the source of vacuum is switched from the loading bar 130 to the trim collector 275, so that during the sewing cycle, the portion of the drapery panel P which is trimmed away will be collected and deposited in the vacuum source 138. At the same time, the sewing motor 232 is energized in a forward mode, the doffing assembly is moved from a position adjacent switch LS-10 to a position adjacent switch LS-9 where it is again deenergized, but in position to complete a doffing cycle for the drapery panel P than being handled. At the end of the sewing cycle or when the sewing machine 230 reaches a position adjacent switch LS-6, the sewing machine motor 232 will be deenergized and the clutch-brake assembly 234 will subsequently be disengaged. As will be noted from FIG. 1, the position of LS-6 stops the sewing machine beyond the edge of the drapery panel P and the cutting assembly 208. Following the deenergizng of the sewing machine motor 232 and the disengaging of the clutch-brake assembly 234, the cutting assembly 208 is energized and severs the strip of buckram material and the stitches thereon at a point substantially in between the edge of the drapery panel P and switch LS-6.

Following the cutting cycle, the position of the sewing machine and the needle plate will be substantially as shown in FIG. 10, discussed hereinbefore.

Following the completion of the cutting cycle, the cutting assembly 208 is deenergized. At the same time, movement of the clamping assembly 106 from its clamped position to its raised position is initiated. As soon as the raising of the clamp assembly is sensed, the doffing assembly 110 is again energized so that the now unclamped, but finished drapery panel P can be removed from the apparatus by the doffing assembly. Following doffing, the completed panel will occupy a position as shown by panels P in FIG. 3.

During the doffing cycle, the sewing motor 232 is energized in its reverse mode and moves the carriage 238 back to its initial, home position adjacent switch LS-11. Since the needle plate 380 is effectively secured to the buckram material 200 by means of the looped stitches 384, the reversing of the sewing machine will pull the next strip of buckram to be applied to the next panel from the supply of buckram shown at 206 which places the sewing machine and strip of buckram in a ready position for the next cycle.

Following a suitable time delay after the initiation of the raising of the clamping assembly to its load position, the raising of the loading bar 130 will be initiated and the vacuum will again be switched from the trim collector to the loading bar 130. Following the completion of the reverse cycle for the sewing machine 230, the sewing machine 230 will be deenergized and at the end of the doffing cycle the doffing apparatus will again be positioned adjacent switch LS-10.

The machine is now in readiness for the next panel and these steps are repeated for each panel P placed in the apparatus.

It will now be clear that there has been provided herein a device which accomplishes the objective heretofore set forth. While the present invention has been disclosed in a preferred form, it is to be understood that the specific embodiment thereof as described and illustrated herein is not to be considered in a limited sense as there may well be other forms of modification of the present invention which should also be construed as coming within the scope of the appended claims.

What is claimed is:

1. A process for sewing a strip of buckram along the top edge of a drapery panel comprising the steps of:

loading the top portion of a drapery panel onto a pivotal support member;

moving the drapery panel into contact with a strip of buckram;

clamping the panel and buckram together along the top portion of the panel seaming the panel and buckram together by moving a sewing machine across the top portion of the panel while simultaneously operating said sewing machine;

severing the buckram and thread adjacent the side of the panel where seaming was completed;

returning the sewing machine to a home position and simultaneously supplying buckram material for the next panel;

unclamping the sewn panel, doffing the panel previously loaded;

and automatically controlling the sequence of process steps after the loading of the panel.

2. A process as claimed in claim 1 wherein the step of loading the drapery panel further includes the step of holding the panel in a relaxed unwrinkled condition until the panel is clamped.

3. A process as claimed in claim 2 further including of step of aligning the top edge of the drapery panel.

4. A process as set forth in claim 1 wherein the step of loading the top portion of the drapery panel includes the step of aligning and positioning the top edge of the drapery panel so that when the panel is placed in contact with the strip of buckram material a portion of the top edge of the panel will extend beyond the strip of buckram whereby that extra portion extending beyond the buckram can be trimmed away during the sewing step.

5. A buckram sewing device for sewing strips of buckram onto the top edge of drapery panels comprising frame means for supporting said device; drapery support means for supporting the upper portion of a drapery panel, said support means being mounted to said frame so as to be movable between a first load position and a second work position; clamp means mounted to said frame means so as to be movable in a timed relationship with said support means between a first load position and a second clamping position, said clamp means cooperating with said support means when each is in said first load position so as to align and position the top edge of the drapery panel so that a portion thereof can be trimmed when the buckram and drapery panel are seamed together and for clamping the buckram and drapery panel when said support means and said clamping means are each in said second position; first drive means attached to said frame means for independently moving each of said support means and said clamping means between said first and second positions; sewing means slidably mounted on said frame means and positioned adjacent said clamp means and said support means for sewing the buckram and drapery panel together, said sewing means being movable between a home position adjacent one corner of the top of the drapery panel when the drapery panel is in its clamped position and a finish position adjacent the opposite top corner of the drapery panel; second drive means for moving said sewing machine means along said frame means between said home and finish positions and for returning said sewing means back to said home position; buckram supply means attached to said frame means adjacent the finish position of said sewing means; cutting means mounted on said frame means for separating the buckram sewed to the drapery panel from the buckram retained on said buckram supply; buckram holding means for holding a portion of the buckram retained on said buckram supply means following the cutting thereof at the termination of the sewing cycle whereby a predetermined length of buckram is pulled from said buckram supply means as said sewing means is returned to its home position and control means for controlling the operation of said device following the loading thereof.

6. A buckram sewing device as claimed in claim 5 further including doffing means mounted on said frame means for automatically doffing completed drapery panels from said device after said cutting means has cut the buckram sewed to the drapery panel from the buckram retained on said buckram supply means and said clamp means has unclamped the completed drapery panel.

7. A buckram sewing device as claimed in claim 5 wherein said support means includes holding means for holding the drapery panel on said support means so that the drapery panel will be held in position until clamped by said clamp means.

8. A buckram sewing device as claimed in claim 7 wherein said support means comprises a closed, hollow chamber extending along the length of the device, having top and bottom surfaces, said top surface being provided with a plurality of apertures opening into said chamber along the side opposite from where said support means is pivotally mounted to said frame means, wherein said device further includes a vacuum source connected to said chamber.

9. A buckram sewing device as claimed in claim 5 wherein said clamp means comprises a clamping bar having a front clamp member extending along the length of said device and two shorter side members one end of each connected to opposite ends of said front clamp member with the opposite ends of each of the side members pivotally connected to said frame means, and a clamp foot member fixedly attached to said front clamp member.

10. A buckram sewing device as claimed in claim 9 wherein said clamp foot member is attached to said front clamp member so as to form a measuring and alignment recess therebetween adapted to receive the top edge of a drapery panel loaded on said support means.

11. A buckram sewing device as claimed in claim 5 wherein said first drive means includes first and second drive elements and linkage means for operatively connecting together said first and second drive elements and for driving said clamp means.

12. A buckram sewing device as claimed in claim 5 wherein said frame means includes support legs of a length sufficient to allow a drapery carrier to be positioned directly beneath said device, and wherein said frame means further includes a raised operator platform.

13. A buckram sewing device as claimed in claim 5 wherein said traversing sewing means includes a carriage platform slidably mounted on said guide means, a sewing machine fixedly attached to said platform, gearing means fixedly attached to said platform for driving said platform along said guide means and drive means for driving said sewing machine and said gear means.

14. A buckram sewing device as claimed in claim 13 wherein said sewing machine is provided with cutting means for trimming a predetermined portion of the top edge of the panel and wherein said traversing sewing means further includes trim collector means for collecting portions of the panel trimmed by said cutting means.

15. A buckram sewing device as claimed in claim 5 wherein the doffing means includes doffing guide means mounted on each side of said frame means perpendicularly to the direction in which said traversing sewing machine is moved for supporting said doffing means, panel engaging means for engaging the panel during the doffing cycle, said engaging means being slidably mounted on said doffing guide means, doffing drive means for driving said doffing means through a doffing cycle and positioning means for positioning said engaging means between engaging and non-engaging positions.

16. A buckram sewing device as claimed in claim 5 wherein said buckram supply means includes tensioning means for providing proper tension to the strip of buckram, a supply roll of buckram and support means fixedly attached to said frame means adjacent the side of said frame means where said traversing sewing means is positioned in its sew complete position for supporting said buckram supply means.

* * * * *